United States Patent [19]

Moore

[11] Patent Number: 4,484,728

[45] Date of Patent: Nov. 27, 1984

[54] ROLLING SEAL SLUICE GATE

[75] Inventor: Richard P. Moore, Germiston, South Africa

[73] Assignee: Blue Circle Projects (Proprietary) Limited, Johannesburg, South Africa

[21] Appl. No.: 406,566

[22] Filed: Aug. 9, 1982

[30] Foreign Application Priority Data

Oct. 8, 1981 [ZA] South Africa ..... 81/5457

[51] Int. Cl.[3] ..... F16K 31/00

[52] U.S. Cl. ..... 251/294; 251/147; 251/230; 251/356; 251/DIG. 2; 405/98

[58] Field of Search ..... 251/DIG. 2, 294, 230, 251/147, 356; 405/87, 91, 98, 102, 106

[56] References Cited

U.S. PATENT DOCUMENTS

| | | | |
|---|---|---|---|
| 55,882 | 1/1866 | Meeker et al. . | |
| 846,170 | 3/1907 | Weeks . | |
| 887,451 | 3/1908 | Blaisdell . | |
| 1,028,640 | 6/1912 | Van Den Heuvel . | |
| 1,506,622 | 11/1923 | Fintel . | |
| 1,533,137 | 4/1925 | Pospisil | 405/98 |
| 1,556,328 | 10/1925 | Hutchins | 251/DIG. 2 |
| 2,592,290 | 1/1950 | Kearsley et al. . | |
| 2,593,969 | 1/1948 | Bowtell . | |
| 3,194,269 | 7/1965 | Williams | 137/614.11 |
| 3,430,677 | 3/1969 | Pierce . | |
| 3,907,250 | 9/1975 | Kane | 251/147 |
| 4,252,461 | 2/1981 | Culamussi et al. . | |
| 4,310,262 | 1/1982 | Calza et al. . | |

*Primary Examiner*—A. Michael Chambers
*Assistant Examiner*—Sheri Novack
*Attorney, Agent, or Firm*—Bacon & Thomas

[57] ABSTRACT

A sluice gate including a closure member comprising a sheet of flexible fabric reinforced polymeric material having pairs of reinforcing members extending horizontally across the sheet with one member of each pair located on the upstream side and the other on the downstream side of the sheet in use. The pairs of members are secured together with the flexible sheet between them and at least some of the members on the upstream side extend beyond the side edges of the sluice opening to be controlled and those on the downstream side are able to pass into the sluice opening. The sluice gate includes control means for drawing the lower end of the closure member upwardly and away from the opening to progressively open it and to allow the closure member to return progressively to the closed position.

17 Claims, 7 Drawing Figures

ROLLING SEAL SLUICE GATE

BACKGROUND TO THE INVENTION

This invention relates to sluice gates for isolating the flow of liquids through sluice openings. In a conventionally designed sluice gate a sliding gate or plate is arranged to cover or uncover the sluice opening. When the opening is closed the pressure of the liquid being isolated is active on the area of the gate covering the opening and causes friction in opposition to opening or closing movement between the gate and the frame against which it seals. In a rigid gate assembly it is also necessary for the gate and the frame against which it seals to be accurately machined to preclude leakage. Because the opening and closing movement is a sliding movement and also because the gate has to be strong enough to withstand the differential pressure on closure it is not easy to incorporate resilient sealing faces.

SUMMARY OF THE INVENTION

An object of the present invention is to provide a sluice gate in which the above disadvantages are overcome to a large degree and to provide a means of reinforcing a flexible gate so that it will withstand the differential pressure on closure and yet provide a completely open unobstructed passage in the open position. A further object is to provide means to reduce the forces necessary to operate the gate and to eliminate friction. A still further object is to provide a means to service the gate without having to drain the liquid in which it is submerged or to carry out the service in the liquid.

According to this invention, there is provided a sluice gate closure member, having a flexible liquid-impervious sheet with approximately horizontally spaced reinforcing members, and being adapted to be suspended from an upper edge thereof across the upstream side of a sluice opening to close it, and to receive control means for drawing the lower end of the closure member upwardly and away from the opening to progressively open it to allow the closure member to return progressively to a closure position, characterised in that reinforcing members are located on the upstream side of the closure member, at least some of which reinforcing members have lengths which extend beyond the edges of a sluice opening to be controlled by the closure member, and in that reinforcing members are also located on the downstream side, and paired opposite those on the upstream side of a length enabling them to pass into the sluice opening which is to be controlled and in which each pair are secured together with the flexible sheet between them.

The invention also provides a sluice gate having a closure member in which the flexible sheet has its upper end secured to a rigid cross-member adapted to be located adjacent the upper wall of the sluice opening and forming part of an assembly adapted to be adjustably secured to the sluice structure above the liquid level at the sluice opening.

Further features of this invention provide for the cross-member and its assembly to be removable with the closure member from the sluice structure for service or repair of the latter.

BRIEF DESCRIPTION OF THE DRAWINGS

These and other features of this invention will become apparent from the following description of preferred embodiments of the invention wherein reference is made to the accompanying drawings in which.

DETAILED DESCRIPTION OF PREFERRED EMBODIMENT OF THE INVENTION

Figure 1:
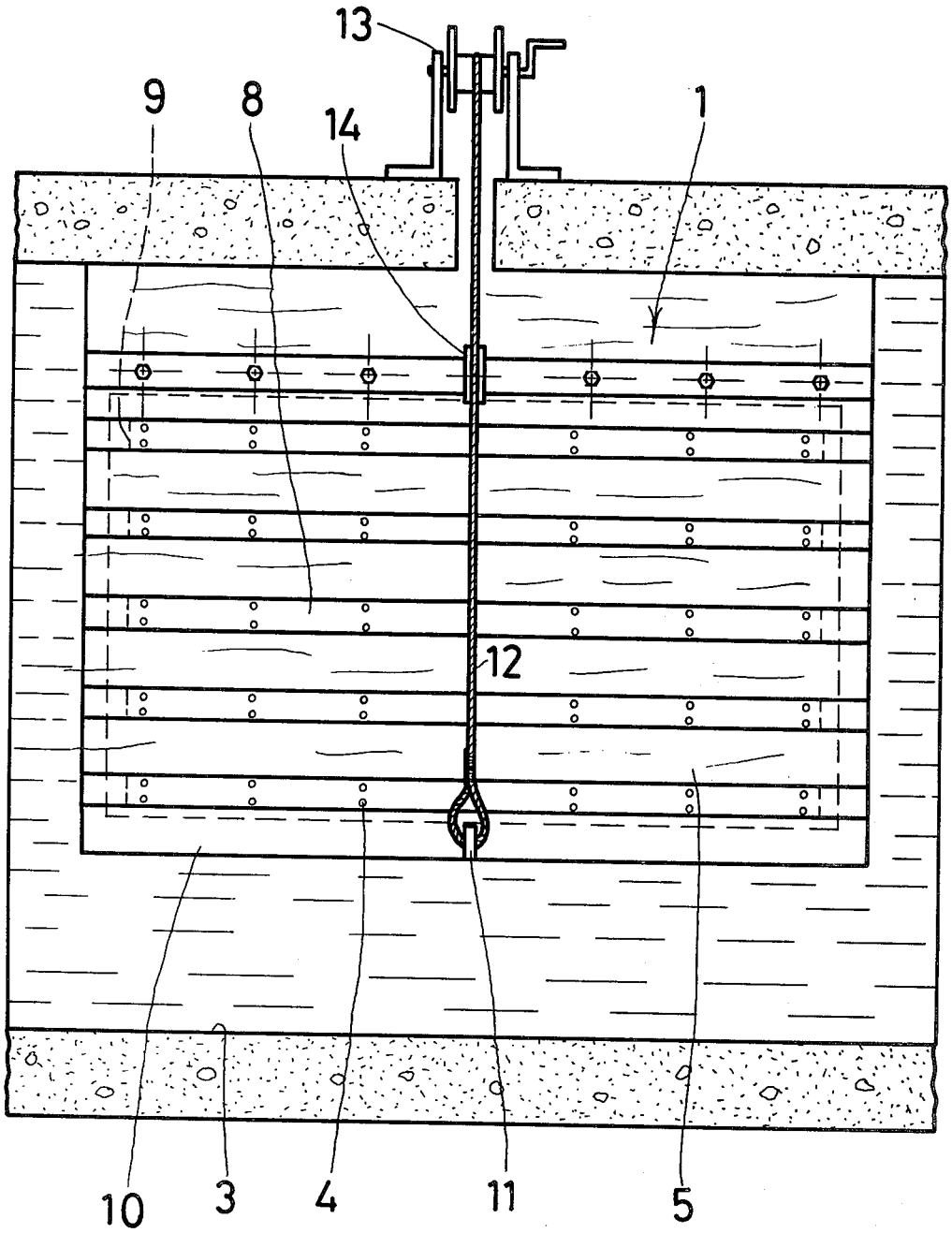
FIG. 1 is an elevation of one form of a sluice gate.
Figure 2:
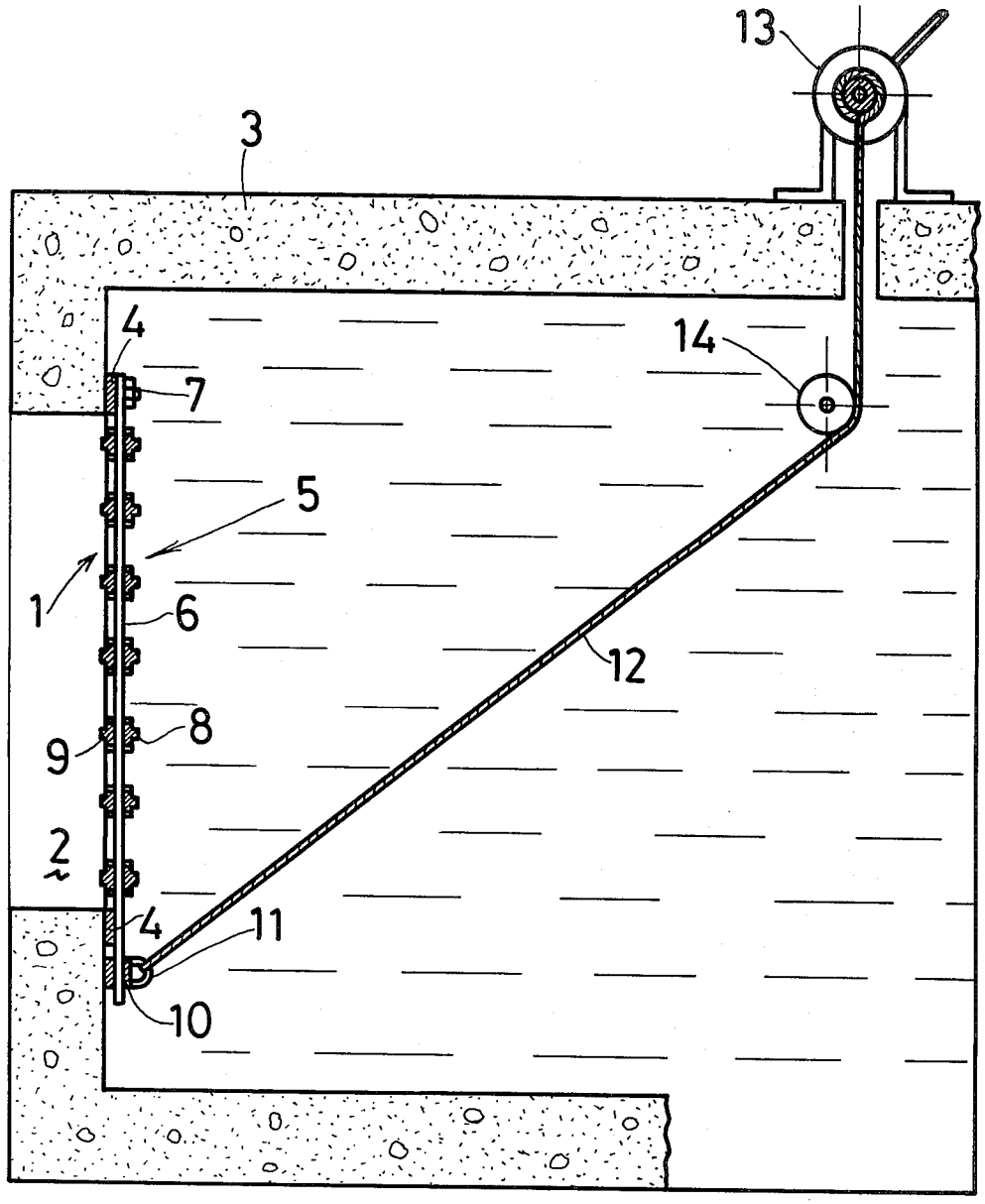
FIG. 2 is a sectional side elevation of FIG. 1.

Referring firstly to the embodiment of the invention illustrated in FIGS. 1 and 2 the sluice gate assembly 1 is mounted to control the flow of liquid through a sluice opening 2 in a concrete chanel 3.

The sluice opening is provided with a metal seating frame 4 secured to the wall around the opening 2 and against which the closure member 5 is to seat. The closure member 5 consists of a flexible sheet 6 of fabric reinforced resistant polymeric material such as rubber, neoprene or other similar suitable material. The fabric re-enforcement prevents the closure member from stretching while not interfering with the resilient seating surface or the flexibility of the member.

A cross-member 7 is provided by means of which the upper end of the closure member is bolted or otherwise suitably secured to the frame 4.

Figure 6:
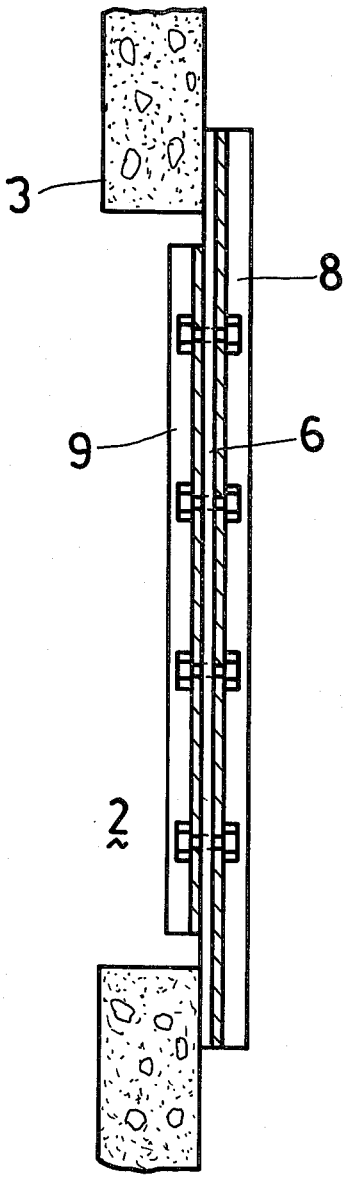
FIG. 6 a cross section through the closure member of the sluice gate.

To support the closure member 5 against the differential pressure to which it is subjected during use to close the sluice opening 2 horizontal reinforcing members are provided. These members are provided in pairs with those 8 on the upstream side of the sheet 6 extending across substantially the full width of the sheet. The full width is adequate to provide sealing faces down each side of the sluice opening 2 and the sheet is also of a length that extends below the bottom edge of the opening 2. The reinforcing members 9 on the downstream side of the sheet 6 are of a length that will enable them to enter into the sluice opening 2 with their ends in close proximity to the adjacent sides of the sluice opening That is most clearly illustrated in FIG. 6 of the drawings.

The pairs of members 8 and 9 are bolted or otherwise secured together with the sheet 6 firmly retained between them. The pairs of members 8 and 9 are vertically spaced apart at the height of the closure member and the spacing is such that there remains sufficient flexibility to enable the sheet 6 to be frequently rolled or peeled away from the sluice opening from the bottom to the top.

The bottom end of the sheet 6 is clamped between a pair of cross-members 10 the upstream one of which is provided with a centrally located eyelet 11 or other suitable means whereby a cable 12 can be secured to the cross-member. It will be understood that "cable" is to be interpreted in this specification to include ropes or chains or rods or other elongate members which can extend between the eyelet 11 and a control means for operating the sluice gate.

Conveniently the control means can be a winch 13 and the cable is, in the embodiment illustrated passed around a guide pully 14 up through a opening to the winch drum. The winch 13 is firmly secured to the upper wall of the chanel.

The winch 13 may be power operated if necessary and other control means such as hydraulic of pneumatic piston and cylinder assemblies can be used if desired.

In use the liquid pressure acts on the closure member 5 to hold it against the resting frame 4 and seal off the opening 2.

To open the gate the winch 13 is operated and the bottom of the closure is lifted off the seating frame 4 and progressively rolled or peeled upwardly until the opening 2 is fully open. When it is desired to close the gate the winch 13 is released and the closure member restores progressively until the influence of gravity and the liquid flow into the closed portion. The differential pressure exerted on the flexible sheet 5 is resisted by the downstream reinforcing member 9 which transmit this load back to the member 8 and to the walls of the chanel around the opening 2.

The method of operation avoids frictional forces on the closure member 5 and the progressive opening requires relatively little effort to bring about full opening of the gate.

Figure 3:
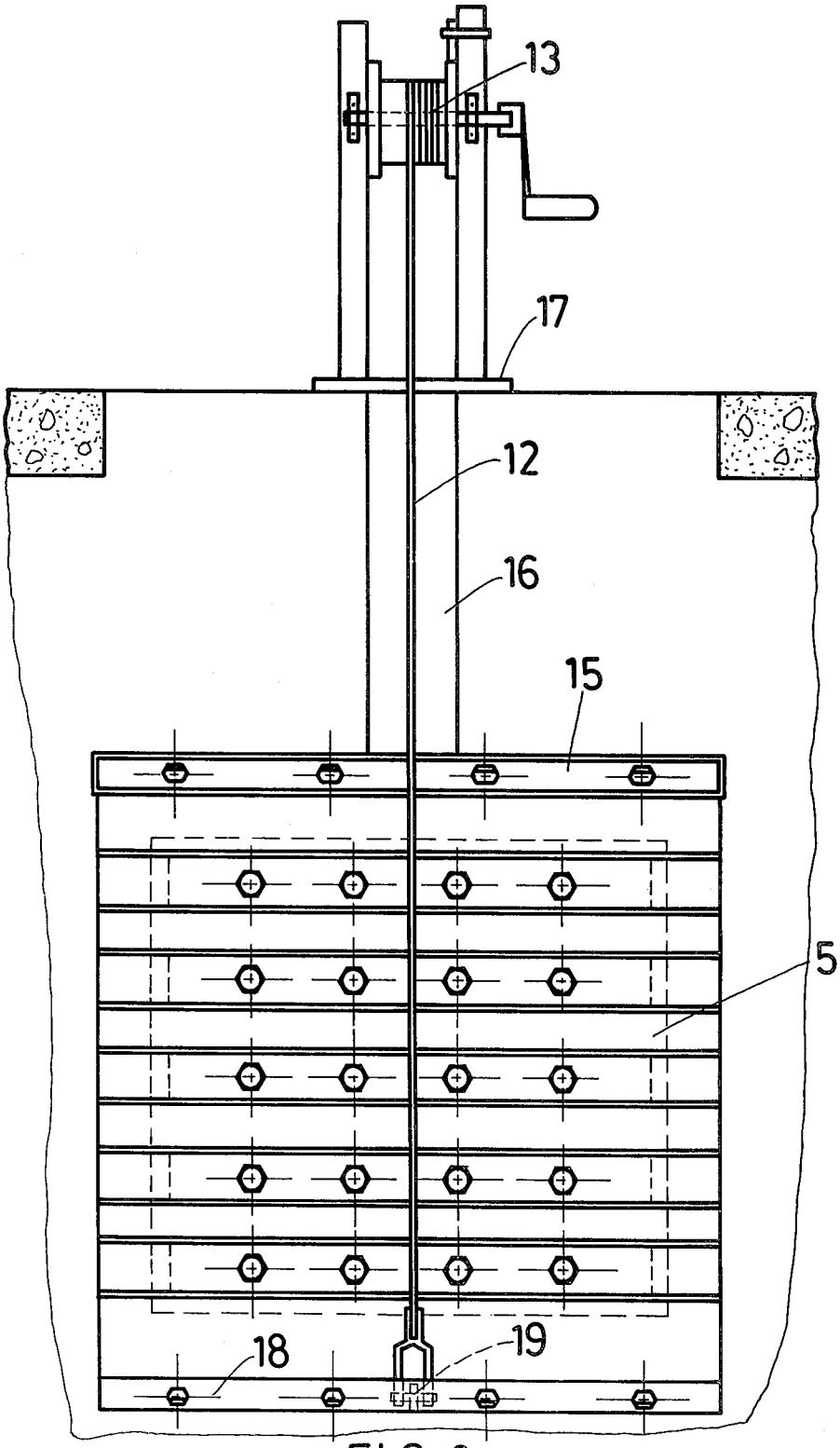
FIG. 3 is an elevation of an alternative form of sluice.
Figure 4:
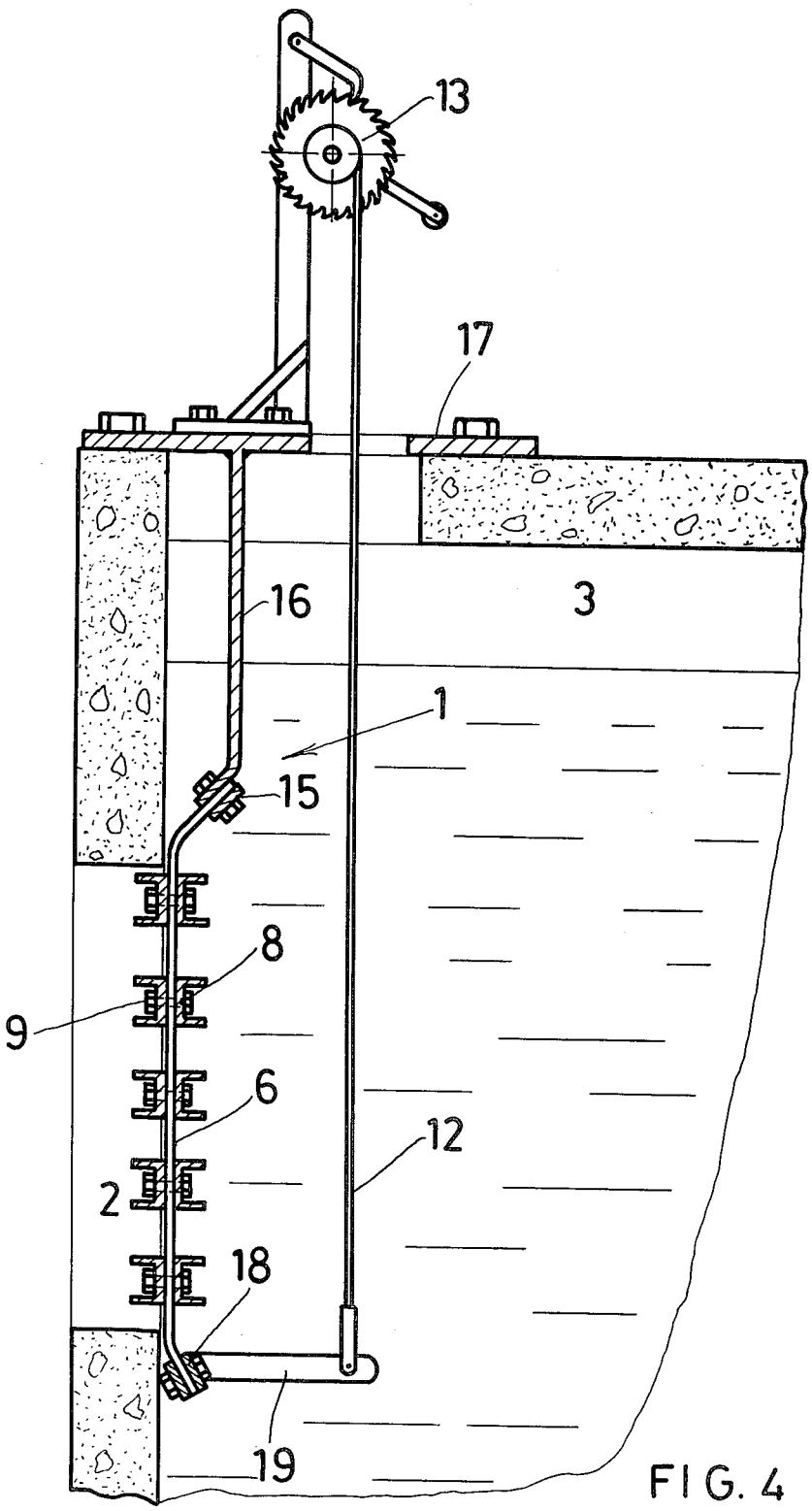
FIG. 4 a sectional side elevation of FIG. 3.
Figure 5:
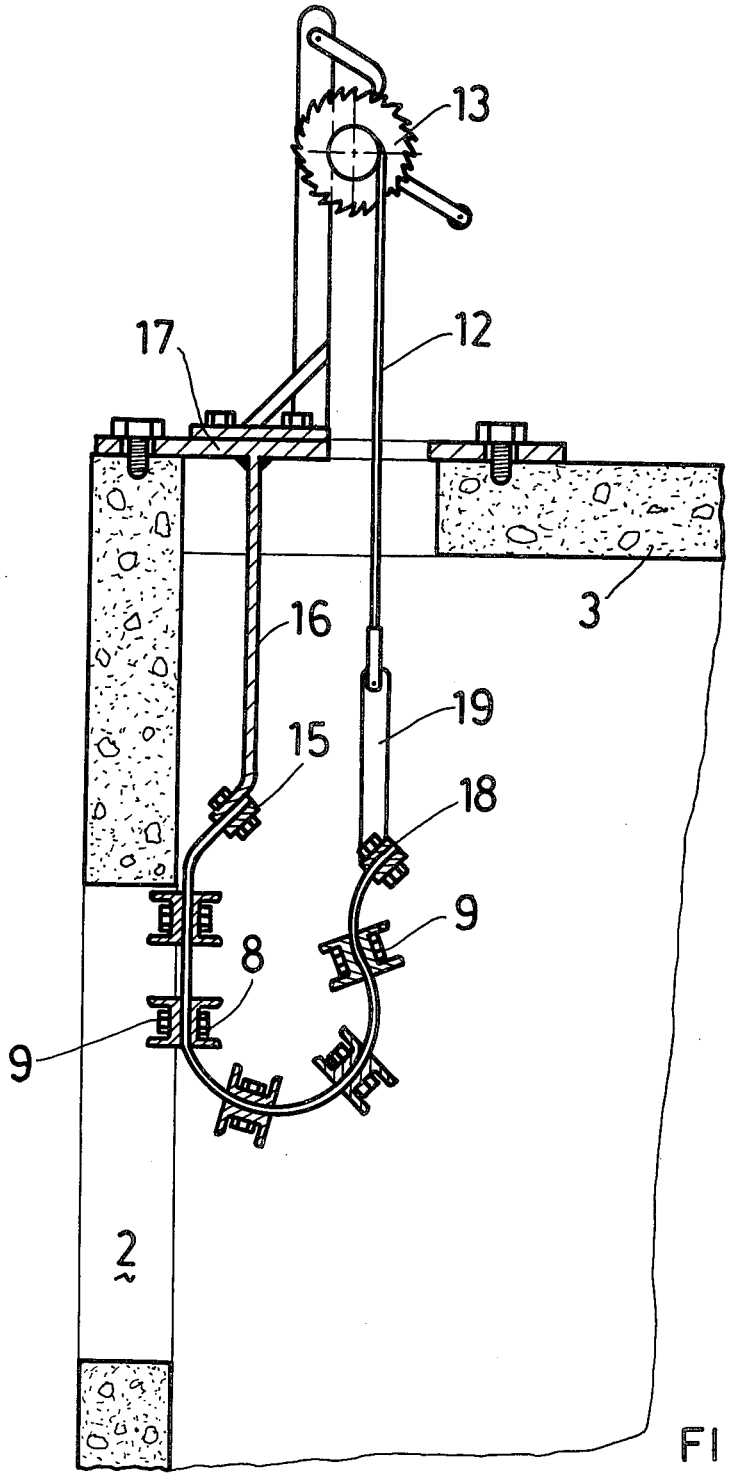
FIG. 5 a similar view to FIG. 4 but with the sluice gate partially open.

FIGS. 3, 4, and 5 illustrate an alternative embodiment of the invention which include other advantages in the assembly than those related to closure member described above.

The embodiment components described above have been allotted the same reference numerals as in the earlier description and not described again.

The closure member 5 is not attached to a seating frame and no such frame need be provided. The member 5 is clasped to a cross-member 15 attached to the end of a depending arm 16 of a bracket assembly 17. The assembly is secured to the upper wall of the chanel above the level of the liquid therein. The bracket assembly is shown bolted to the concrete structure and the bolting arrangement is such that adjustment of the depending arm 16 and consequently the portion of closed member 5 relative to the sluice opening 2 can be affected. The upper cross-member 15 is inclined downwardly towards the sluice opening so that the top of the closure member is biased towards the wall above the opening 2.

In FIGS. 4 and 5 the flexible sheet 6 is shown not in tight engagement with the wall around the opening. It will of course be appreciated that the sheet will firmly abut the wall when the gate is in use.

The lower end of the closure member 5 is secured to a cross-member 18 which is downwardly inclined away from the sluice opening 2. This also biases the closure member towards the wall around the opening.

Projecting from the cross-member 18 at right angles to the wall is a rigid arm 19 to the free end of which is attached the control cable 12 for the gate. The length of the arm is such that sufficient leverage is provided to enable the control cable to exert substantially vertically while still enabling a simple control mechanism such as the winch 13 to be used to operate the gate. The winch 13 will preferably be mounted on the bracket assembly and may be removable therewith from the chanel structure.

This embodiment operates generally in the same manner as that previously described but it also enables the closure member to be repaired or replaced without draining of the chanel or work being done beneath the surface of the of the liquid. The bracket assembly can be released and removed from the chanel while repair or replacement work is undertaken.

Further the closure member will seat directly against the concrete around the source opening 2 and the expense of installing a metal frame 4 around the opening is avoided.

Figure 7:
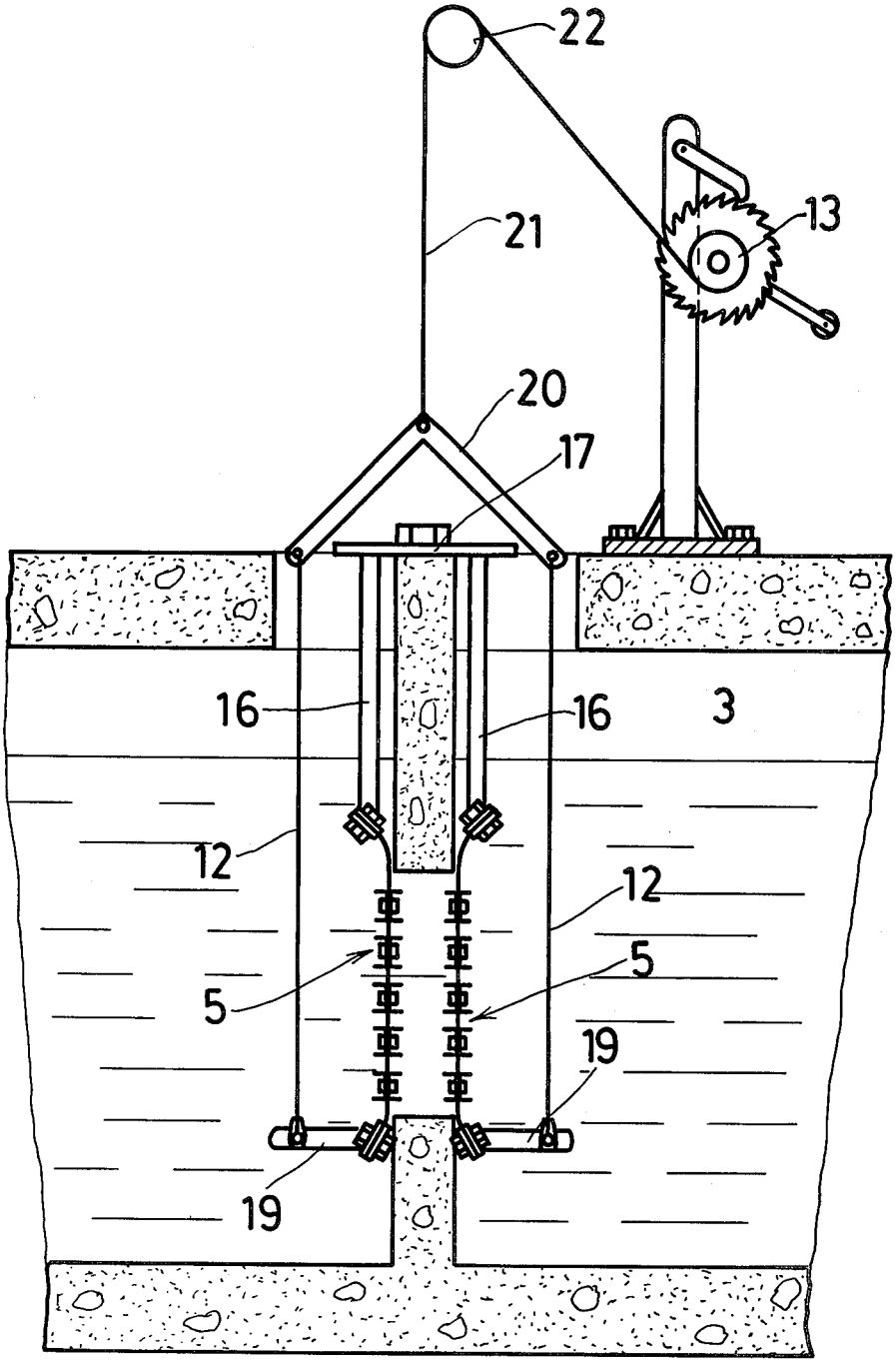
FIG. 7 is a sectional side elevation showing a sluice gate suitable to isolate flow in both directions through the sluice opening.

Yet a further embodiment of the invention is illustrated in FIG. 7 of the drawings. This embodiment may be used when it is necessary or desirable to provide a sluice gate assembly which can isolate flow in both directions through the sluice opening.

The gate assembly is substantally a double closure assembly as described with reference to FIGS. 3, 4, and 5 but utilising a single winch mechanism. One closure member is associated with each end of the sluice opening 2 through the sluice wall and the two control cables 12 are secured to the ends of a bifurcated lever 20 for correction to the winch cable 21. This cable passes over a guide pully 22 to the winch drive. The pully rig, where loads on the gate assembly allow be dispensed with and the cable taken directly to the winch drive located directly above the sluice wall.

Many modifications and variations to the embodiment above described are to be made without departing from the scope of this invention. In particular other operating mechanisms can be used to progressively open and close the gate in the manner set forth and locking means will preferably be included to enable the gate to be secured at any stage of opening.

What I claim as new and desire to secure by Letters Patent is:

1. A closure member for a sluice gate opening having a predetermined height and width dimensions comprising:

(a) a flexible, liquid impervious sheet having height and width dimensions greater than those of the sluice opening;

(b) attaching means to attach an upper edge of the flexible sheet to the sluice structure such that the flexible sheet is disposed over an upstream side of the sluice opening;

(c) a plurality of pairs of generally horizontal members attached to the flexible sheet, a first one of the pair being attached to an upstream side and a second one of the pair being attached to a downstream side adjacent the first, such that the pairs are vertically spaced apart from each other, at least some of the reinforcing members on the upstream side of the flexible sheet having a length greater than the width of the sluice opening, and the reinforcing members on the downstream side having a length less than the width of the sluice opening to enable them to move into the opening; and, (d) control means connected to a lower edge of the flexible sheet for moving the lower edge upwardly or downwardly to open or close the sluice opening.

2. A sluice gate closure member as claimed in claim 1 in which at least some downstream reinforcing members have at least one end thereof able to pass into the sluice opening in close proximity to an adjacent wall of that opening.

3. A sluice gate closure member as claimed in claim 2 in which all the reinforcing members on the upstream side have lengths exceeding the width of the sluice opening and all the reinforcing members on the downstream side have their ends able to pass into the sluice opening in close proximity to an adjacent wall of the opening.

4. A sluice gate closure member as claimed in claim 1 in which the flexible sheet is made from fabric reinforced resilient polymeric material.

5. A sluice gate closure member as claimed in claim 4 in which the polymeric material is neoprene.

6. A sluice gate closure member as claimed in claim 1 wherein the attaching means comprises:

(a) a rigid cross-member located adjacent to an upper wall of the sluice gate opening having the upper edge of the flexible sheet attached thereto); and, (b) means to adjustably attach the rigid cross-member to the sluice structure.

7. A sluice gate closure member as claimed in claim 6 in which the cross-member is shaped and located in use to bias the flexible sheet towards the sluice opening.

8. A sluice gate closure member as claimed in claim 6 in which the rigid cross-member and its attachment means are removably attached to the sluice structure such that they are removable with the closure member from the sluice structure for service or repair of the latter.

9. A sluice gate closure member as claimed in claim 6 further comprising a second cross-member secured to the lower end of the flexible sheet, the second cross-member inclined downwardly away from the sluice opening when the gate is closed and means connecting the cross-member to the control means for the gate.

10. A sluice gate closure member as claimed in claim 6 in which the control means comprises a winch and cable.

11. A sluice gate closure member as claimed in claim 10 in which the winch is located so that the cable extends at an angle of approximately forty-five degrees from the lower end of the flexible sheet when the gate is closed.

12. A sluice gate closure member as claimed in claim 10 further comprising a rigid arm projecting from the second cross-member secured to the lower end of the flexible sheet away from the sheet such that the winch cable attached to the free end thereof and the winch are located so that the cable extends substantially vertically.

13. A sluice gate closure member as claimed in claim 12 wherein the means to adjustably attach the rigid cross-member further comprises mounting means to which the winch is mounted.

14. A sluice gate closure member as claimed in claim 9 wherein the sluice opening has an upstream side and a downstream side and further comprising:

(a) a second flexible, liquid impervious sheet having height and width dimensions greater than those of the sluice opening;

(b) a second plurality of pairs of generally horizontal reinforcing members attached to the second flexible sheet, a first one of the pair attached to a downstream side and a second one of the pair attached to an upstream side adjacent the first such that the pairs are vertically spaced apart from each other, at least some of the reinforcing members on the downstream side having a length greater than the width of the sluice opening, and the reinforcing members on the upstream side having a length less than the width of the sluice opening to enable them to move into the opening;

(c) attaching means to attach the second flexible sheet to a downstream side of the sluice opening comprising a third rigid cross-member located adjacent to an upper wall of the sluice opening having an upper edge of the second flexible sheet attached thereto and means to attach the third rigid cross-member to the sluice structure;

(d) a fourth cross-member attached to a lower edge of the second flexible sheet, the fourth cross-member inclined downwardly away from the sluice opening; and, (e) means connecting the fourth cross-member to the control means.

15. A sluice gate closure member as claimed in claim 14 wherein the second flexible sheet is made from fabric reinforced resilient polymeric material.

16. A sluice gate closure member as claimed in claim 15 wherein the polymeric material is neoprene.

17. A sluice gate closure member as claimed in claim 14 in which the control means comprises a winch and cable.

* * * * *